United States Patent [19]

Wirtgen

[11] 3,989,304

[45] Nov. 2, 1976

[54] MACHINE FOR CUTTING AWAY ROAD SURFACES

[76] Inventor: Reinhard Wirtgen, Hohnerstrasse, 5461 Windhagen uber Linz, Rhine, Germany

[22] Filed: Feb. 24, 1975

[21] Appl. No.: 552,185

[30] Foreign Application Priority Data

Mar. 8, 1974 Germany ..... 2411244
Mar. 14, 1974 Germany ..... 2412172

[52] U.S. Cl. ..... 299/39
[51] Int. Cl.[2] ..... E01C 23/12
[58] Field of Search ..... 299/10, 39, 40

[56] References Cited

UNITED STATES PATENTS

| | | | |
|---|---|---|---|
| 3,572,842 | 3/1971 | Mori | 299/39 |
| 3,694,033 | 9/1972 | Christensen | 299/39 |
| 3,829,161 | 8/1974 | Wirtgen | 299/39 |
| 3,868,146 | 2/1975 | Ellis | 299/39 |

*Primary Examiner*—Ernest R. Purser
*Assistant Examiner*—William F. Pate, III
*Attorney, Agent, or Firm*—Steinberg & Blake

[57] ABSTRACT

A Machine for cutting away road surfaces has a chassis which is preferably self-propelled and which has an intermediate portion situated above the road surface which is to be worked. Beneath this intermediate portion of the chassis is a frame which carries at least one cutter roller which extends transversely with respect to the direction of travel of the chassis. The cutter roller is driven from a gear which is also carried by the frame and which is connected to a drive by way of a Cardanic-type shaft. The frame is suspended from the chassis by only two supports which at their lower ends are connected to the frame in a plane which includes a substantially central longitudinal axis of the chassis to support the frame for free tilting movement about an axis in this plane which extends in the general direction of travel of the chassis, so that by way of this two-point suspension the frame together with the cutting roller can tilt laterally. The frame carries a pair of ground-engaging rollers which are connected to the frame by way of adjusting structures capable of adjusting the frame with respect to the rollers so that in this way it is possible to adjust the angle of transverse tilt of the cutting roller. At least one of the suspensions for the frame can be raised or lowered so that the entire frame together with the cutting roller can be raised away from the ground during travel of the machine.

6 Claims, 4 Drawing Figures

MACHINE FOR CUTTING AWAY ROAD SURFACES

Figure 1:
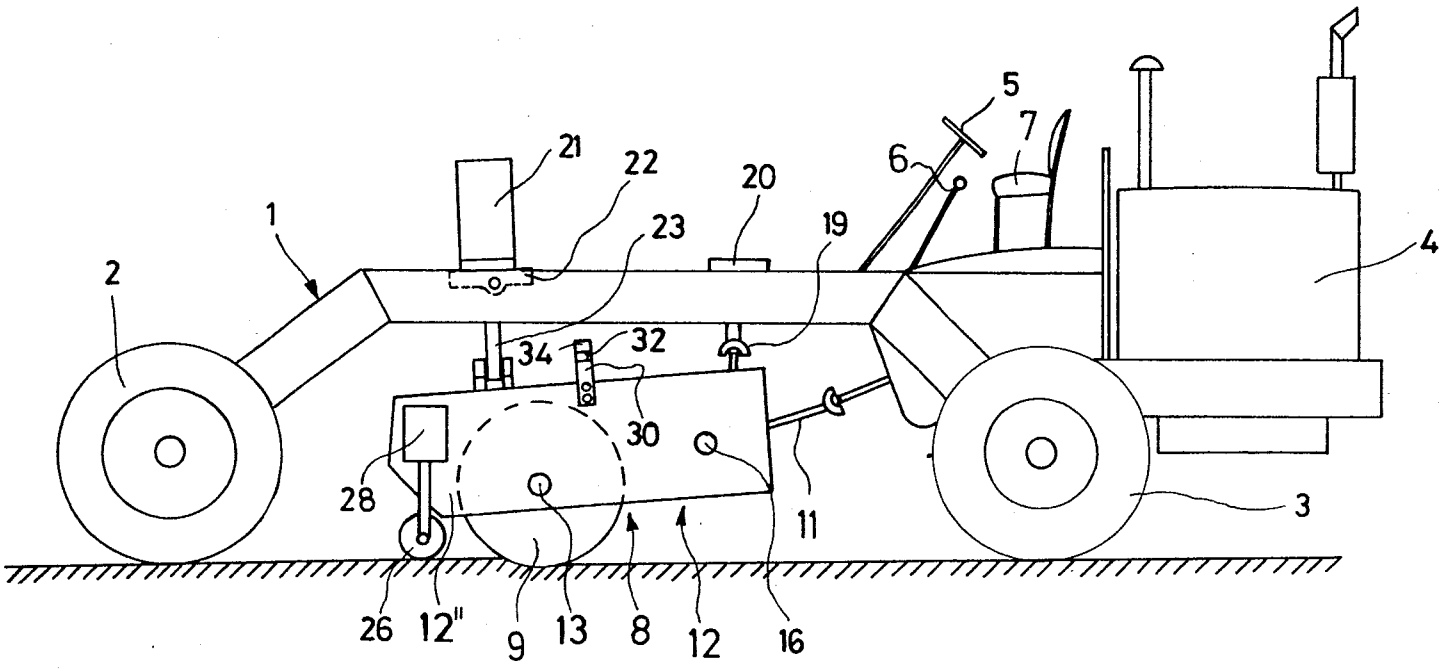

This invention relates to a machine for cutting away road surfaces comprising a preferably self-propelled chassis and at least one cutter roller arranged on it and vertically adjustable, which is operatively connected via a gear and a Cardanic type shaft to a drive motor, said cutter roller, or cutter rollers, respectively, and the gear forming a structural unit which in the working position, transversally to the direction of travel, is pivoted, directly or indirectly inclinable, to the chassis. The invention is moreover applicable to such machines for cutting away road surfaces where the cutter roller or at least one of the cutter rollers extends, in the working position thereof, on at least one side of the machine, beyond the outer longitudinal boundary line, the cutter roller, or cutter rollers, respectively, and the gear are arranged on a carrier on the chassis rotatably supported around a somewhat vertical axis, and between the gear and the drive motor there is provided a coupling.

Because the possibility of inclining the structural unit, any inclination of the machine around its longitudinal axis can be compensated for by a corresponding adverse inclination of either the cutter roller or of the structural unit comprising cutter roller and gear. Thus the cutter roller can mill off the damaged road surface over the whole width of the cutter roller for the same amount even if the machine, for instance when milling the edges of road surfaces, has to travel with the wheels of one chassis portion on the side slope or on the pavement.

Because of the heavy weight of the structural unit which comprises cutter roller, gear, drive means between gear and cutter roller, the frame which receives all these elements, supporting elements and the like, the structural unit has, in the machines hitherto known, as have for instance been described in German Offenlegungsschrift No. 2,203,530, been suspended, directly or indirectly, at three points at the chassis. One of the three suspending elements is formed as a Cardanic-type coupling while the two other suspending elements are secured at one end, rotatable around an axis, to the frame and are each connected with an hydraulic piston drive. These piston drives serve for the adjustment of the desired inclination and the milling depth and for lifting and lowering, respectively, the roller cutter when changing from milling operation to pure travelling operation, and vice versa.

A machine of this kind which includes such a suspended structural unit has shown to be very useful in daily operation, particularly as concerns the requirements as to stability, non-susceptibility to trouble, and simplicity in the operation. A disadvantage for certain purposes of application however is the too-small inclination of the structural unit as well as the relatively complicated control system for the two hydraulic piston drives. The latter can be attributed to the fact that the pistons of the two drives must either be moved separately from each other for the adjustment of the inclination or, for any inclinatiton, at the same time and with the same stroke for the adjustment of the milling depth.

In order to be able to cut away in as little time as possible as large road areas as possible, machines have been developed which either posses a very broad cutter roller or a plurality of cutter rollers staggeredly arranged in several rows one after the other, the total broadness of which is that great that the cutting device, in the working position, extends beyond the longitudinal boundary line of the machine. In order to simplify the handling of the machine, for instance in the transport from the parking area to the place of operation, it has already been known to arrange the cutter roller, or the cutter rollers, respectively, as well as the gear on a carrier rotatably supported around a vertical axis on the chassis. In such a machine, the cutting device can, in case of pure travelling operation, be swivelled into a position where the whole cutter roller, or cutter rollers, respectively, are within the outer longitudinal boundary lines of the machine, and can be returned into the position transversal to the longitudinal axis at the beginning of the cutting operation. Such swivelling of the cutting device permits the use of either very long cutter rollers or of a plurality of cutter rollers arranged one beside the other.

In the prior art machines, as have for instance been described in German Offenlegungsschrift No. 2,203,529, the carrier for the cutter roller, or the cutter rollers, respectively, and the gear rests on a portion of a ring mount the other portion of which is mounted to the chassis. Such a ring mount has particularly with a view to the requirements of stability, non-susceptibility to trouble, and carrying capacity in view of the heavy structural unit shown to be very good in daily operation. It is however a disadvantage that such a ring mount is rather costly and the mounting thereof is connected with difficulities because of its heavy weight. If now these difficulties and disadvantages are to be avoided by supporting the structural unit on a carrier and support said carrier either on a or below a traverse arranged perpendicularly to the longerons of the chassis, which would be a simple way out, it has proved that in this case, because of the component parts which hang down from the carrier or of the general elements which are arranged on the carrier, such as fluid motors and the like, the cutter roller, or the cutter rollers, respectively, could be rotated only for a relatively small angle of rotation. The consequence would be that in such a structure the effective length of the cutter roller, or the cutter rollers arranged one beside the other, respectively, should be shortened which would have an unfavorable influence on the efficiency of the machine.

It is therefore an object of the invention to provide a machine for cutting away road surfaces where the cutter roller, or the cutter rollers, respectively, can simply and without great costs be inclined transversally relative to the direction of travel and where the inclination and supporting arrangement of which is so devised that it can also be used in machines having excessively broad cutter devices.

In accordance with the invention, the problem is solved in that the structural unit comprising cutter roller or cutter rollers, respectively, and gear is supported by a two-point suspension.

In a first embodiment of the invention, the structural unit is directly secured to the chassis by means of the two-point suspension.

In a further embodiment which is particularly advantageous for machines having excessively broad cutter devices, the structural unit is supported by means of a two-point suspension on a carrier which on its part is rotatably supported on a diagonal traverse provided on the chassis.

By so doing not only an essentially better inclination as compared to a three-point suspension is obtained together with only little constructional volume and the control system is very much simplified; in a machine having an excessive broadness, the two-point suspension on a carrier together with the support thereof in a diagonal traverse permits a swivelling of the cutter roller, or the cutter rollers, respectively, round through 90° or more, i.e. a swivelling from the cutting position transverse to the direction of travel into the rest position parallel to the direction of travel, while the structures on the carrier do not thrust against the diagonal traverse. Such a diagonal traverse is not only very much cheeper as compared to a ring mount but can also be mounted to the chassis without any difficulties.

In a structural unit which is suspended in accordance with the present invention, the adjustment of the inclination can be effected in various ways. In order to adjust the inclination of the structural unit consisting of cutter roller and gear, it has proved to be particularly advantageous to secure, on each side of the line passing through the two suspension points, a vertically adjustable supporting wheel each. By such supporting wheels which are preferably arranged in the neighborhood of the cutter roller not only the two suspension elements are essentially relieved and vibrations which might come up in the milling process are absorbed (both features add favorably to the life time of the suspension elements), but also a higher cutting exactness is obtained so that now also a higher cutting exactness is obtained so that now also the surfaces of road coatings can be milled, which was hitherto not possible with the exactness desired.

The two supporting wheels can be adjusted either manually or, which may be more suitable with a view to a rapid and simple adjustability, by motor. While electric motors as well as fluid motors can be used as the servomotors, fluid motors will, in general, be preferred as they can without difficulity be included into the already-existing hydraulic system of the machine and as there will be no problems with the feed energy as might be the case with electric motors. In this way, the cutting depth can be adjusted even in the course of the cutting process.

With a view to a great inclination of the structural unit and a small load of the suspension elements by torsional and bending forces, it has shown to be of advantage to arranged the suspension points in a plane perpendicular to the cutter roller axis.

Vertical adjustment of the structural unit could also be made via the supporting wheels. As this however would require a relatively complicated control system and, still more important, the structural unit would be supported via the supporting wheels on the road surface also during pure travel operation, for instance when being moved from the parking lot to the place of operation, which would lead to an essential decrease of the allowed maximum speed of the machine, preferably at least one of the two suspension elements is made vertically adjustable. With a view to a rapid and simple adjustment, it is recommended to use, as in the case of the supporting wheels, vertical adjustment by motor of the suspension element, or suspension elements, respectively. As the servomotor, a fluid motor is to be preferred to the electric motor which however might be used, too.

Particularly in the latter embodiment where vertical adjustment of the structural unit is not effected via the supporting wheels, it is recommended to provide means for avoiding a movement of the structural unit while in an elevated state. It has shown that the structural unit which for instance during pure travel operation is drawn towards the chassis frame, is moved to and fro by the usual movements of the vehicle and starts to swing when the suspension points are arranged in a central plane perpendicular to the cutter roller axis, which is unfavorable for the travelling behavior of the machine.

In order to avoid these movements, there are preferably provided releasable bracings between the structural unit comprising cutter roller and gear and the chassis, which connect the elevated structural unit with the chassis and are released by the operator before the unit is lowered. A further particularly advantageous solution can be seen in that the structural unit comprising cutter roller and gear and/or the chassis are provided with stops which operate, when the structural unit is elevated, either with one another or with the sturctural unit or with the chassis. In this case, the time consuming releasing of the bracings by the operator is no longer necessary, which is favorable for a short setting time of the machine. It has provided to be of advantage if every stop consists, at least partly, of a hard-elastic material such as hard rubber. In this way rattle noises and damage of the structural unit or the chassis, respectively, can safely be avoided.

In a machine for cutting away road surfaces having at least one cutter roller extending, in the operation position, beyond the outer longitudinal boundary line where the cutter roller, or the cutter rollers, respectively, and the gear are arranged on a carrier supported on the chassis and rotatable around a vertical axis, the carrier is, in one embodiment of the invention, rotatably supported in a diagonal traverse provided on the chassis. In an embodiment which is preferred for production and mounting reasons, the carrier is provided with a pin arranged midway between its two ends and supported in a corresponding receiving device in the diagonal traverse which contains at least one axially loadable ball or roller bearing. A particularly simple and stable support of the carrier can be obtained in that the carrier is arranged above the diagonal traverse. Such a support wherein the carrier is inserted with its pin from above into the receiving device in the diagonal traverse, has moreover particular advantages in the assembling process as compared to a suspending support of the carrier which would be possible, too.

Generally, the cutter roller, or the cutter rollers, respectively, and the gear are taken together to form a structural unit which is vertically adjustably secured to the carrier. Hitherto, the structural unit has in view of the heavy weight been suspended in three points. Such a suspension however can cause that the structural unit cannot be swivelled round full 90°. This is avoided by the two-point suspension.

Figure 2:
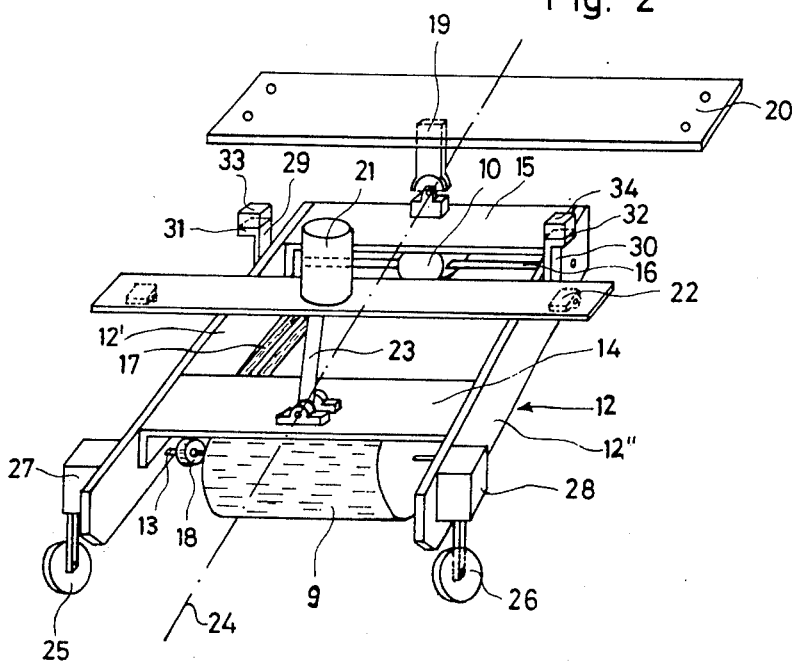
Figure 3:
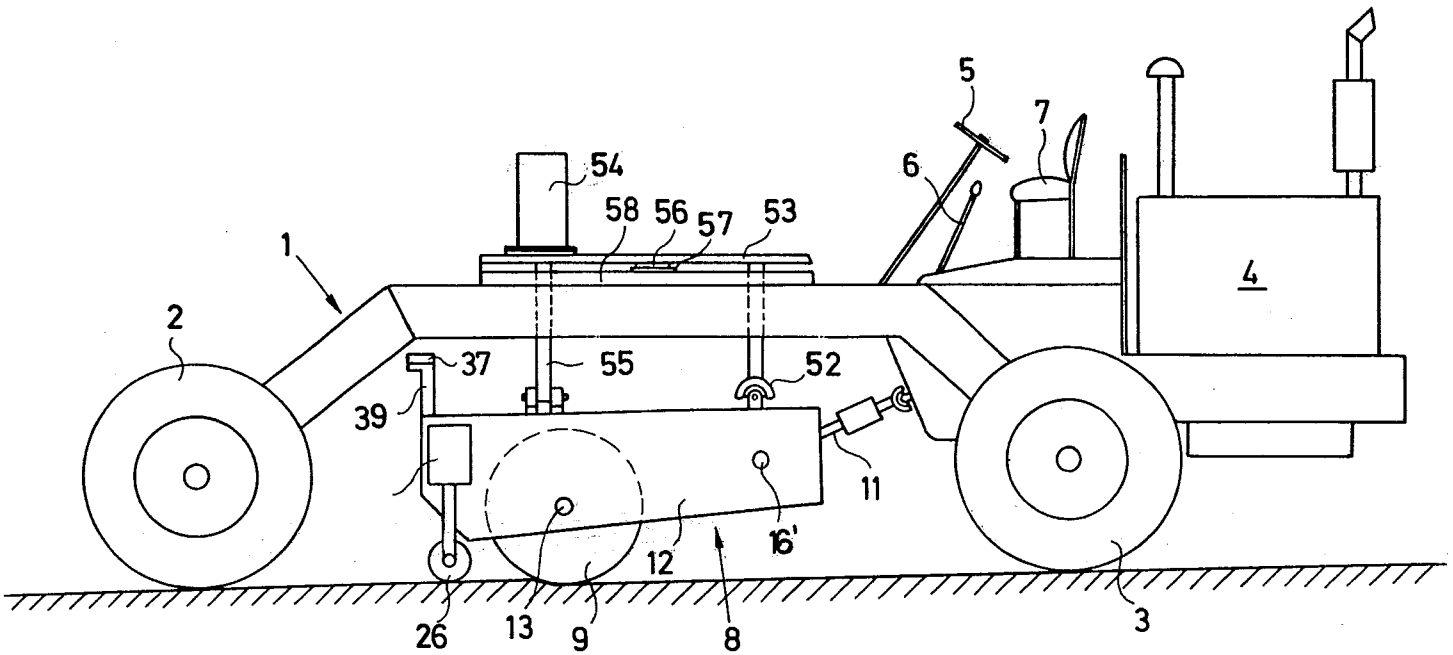
Figure 4:
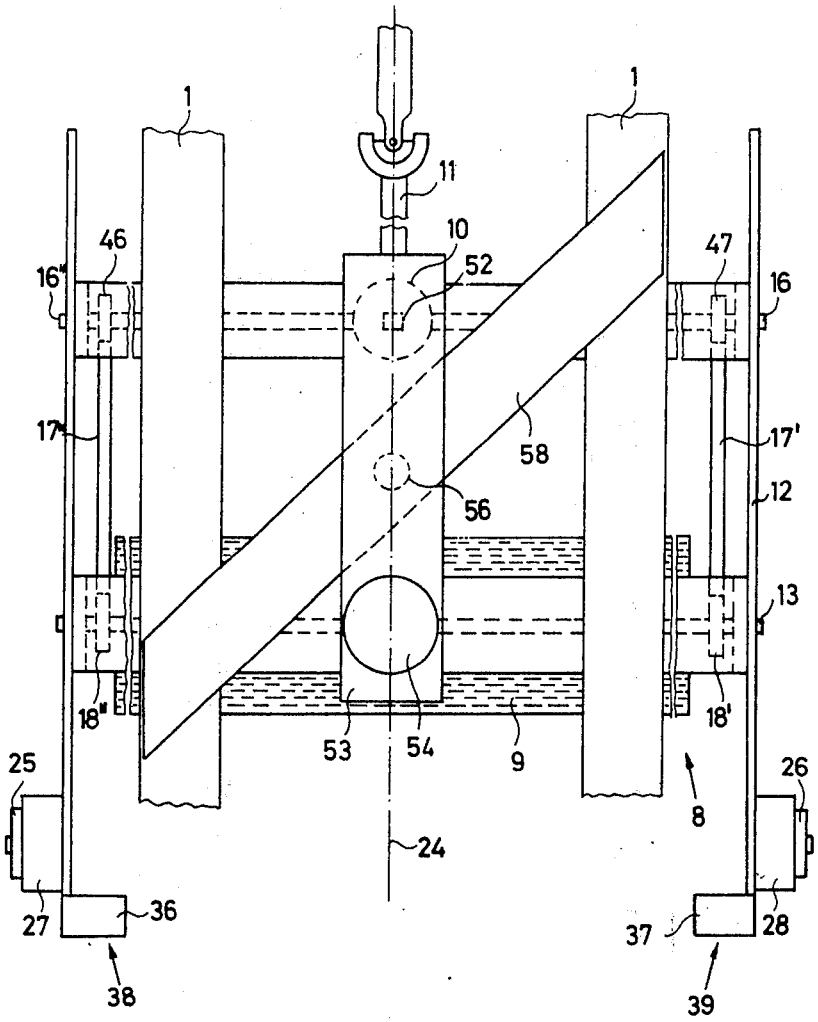

The invention will now be described in detail in connection with the accompanying drawings which, partly in a schematic view, show various embodiments of the invention, wherein FIG. 1 is a side view of an embodiment of the machine according to the invention, FIG. 2 shows a perspective view of the structural unit including one suspension according to FIG. 1, FIG. 3 shows a side view of a further embodiment according to the invention of the machine including a broad cutter roller, and FIG. 4 shows a top view of that portion of the machine according to FIG. 3 that carries the diagonal traverse.

The machine shown in FIG. 1 for cutting road surfaces comprises a chassis 1 including two steerable front wheels 2 and two rear wheels 3 as well as a diesel engine 4 provided in the rear chassis portion and driving the two rear wheels 3. In front of the diesel engine 4, there are the controls necessary for operating the machine such as steering wheel 5, levers 6 and so forth as well as seat 7 for the driver. Between front wheels 2 and rear wheels 3, cutting device 8 is arranged. The latter comprises essentially cutter roller 9 provided with cutters, which via gear 10 (FIG. 2) and Cardanic-type shaft 11 is in operative connection with diesel engine 4.

As can be taken from FIG. 2, cutter roller 9 is supported with its shaft 13 in a frame 12 composed of two longitudinal portions 12′ and 12″ and two crossbars 14 and 15 connecting them. In the rear portion of frame 12, there is provided gear 10 the driving shaft 16 of which is also supported in side portions 12′ and 12″. On the end of shaft 16 neighboring side portion 12′, there is a sprocket wheel which drives, via chain 17, sprocket wheel 18 provided on cutter roller shaft 13.

The structural unit comprising cutter roller 9 and gear 10 supported in frame 12 is secured, by means of a two-point suspension, to chassis 1. The two-point suspension comprises Cardanic-type joint 19 which engages, in the central plane perpendicular to the cutter roller axis, with crossbar 15, on one hand, and with bracing 20 directly screwed, or welded, to chassis 1, on the other, as well as an hydraulic piston drive 21 secured to mounting support 22 hinged to chassis 1, the piston rod 23 of which is swivel mounted, in the central plane perpendicular to the cutter roller axis, on cross bar 14. Vertical adjustment of the structural unit can be effected by piston drive 21.

In addition, there is secured to the structural unit comprising cutter roller 9 and gear 10, on each side of line 24 passing through the two suspension points and on locations on longitudinal portions 12′ and 12″ facing each other a vertically adjustable supporting wheel each, 25 and 26, for the adjustment of the inclination. Both supporting wheels, 25 and 26, are in the immediate neighborhood of cutter roller 9. For the adjustment of supporting wheels 25 and 26, an hydraulic piston drive each, 27 and 28, is provided.

In order to avoid movements, particularly swivelling movements of the structural unit comprising cutter roller 9 and gear 10, when in the elevated state, there is secured to each longitudinal portion 12′ and 12″ a support rod 29 and 30 respectively, having bent ends 31 and 32, respectively. In the elevated state of the structural unit, the bent end which is provided with hard rubber buffers 33 and 34, respectively, presses on the neighboring longeron of chassis 1 so that no swivelling movement of the structural unit can occur.

In the further embodiments of the machine according to the invention shown in FIGS. 3 and 4, the width of the cutting device is considerably greater than the total width of the machine.

Cutter roller 9 and gear 10 are assembled in a frame in which cutter roller 9 with its shaft 13 and drive shafts 16′ and 16″ of gear 10 are supported to constitute a structural unit. On each of drive shafts 16′ and 16″ there is provided, as can be taken from FIG. 4, a sprocket wheel 46 and 47, respectively, which is connected, via chain 17′and 17″, respectively, with sprocket wheel 18′ and 18″, respectively, provided on cutter roller shaft 13.

The structural unit comprising cutter roller 9 and gear 10 is secured to chassis 1 by means of a two-point suspension. The two-point suspension comprises Cardanic-type joint 52 which engages, in the central plane perpendicular to the cutter roller axis, with frame 12 on one hand, and with carrier 53, on the other, and a hydraulic piston drive 54 secured to the other end of carrier 53 and whose piston rod 55 is swivel mounted, in the central plane perpendicular to the cutter roller axis, to frame 12.

Carrier 53 is provided with pin 56 arranged midway between its two ends which is supported in a corresponding receiving device 57 containing two axially chargeable roller bearings and arranged on a diagonal traverse 58. Swivelling of carrier 53 arranged above diagonal traverse 58 can be effected either manually or by a motor. For the sake of clarity, the motoric drive which is to be preferred is not shown.

Furtheron, there is secured to the structural unit, on each side of line 24 passing through the two suspension points and in locations facing each other of frame 12, in the immediate neighborhood of cutter roller 9, a vertically adjustable supporting wheel 25 and 26 respectively. For the adjustment of supporting wheels 25 and 26, with the aid of which the inclination of the cutter roller or the cutting depth, respectively, can be regulated, an hydraulic piston drive 27 and 28 respectively, is provided.

In order to avoid movements, particularly swivelling movements of the structural unit in the elevated state (elevating and lowering of the structural unit is effected by operating hydraulic piston drive 54), there are secured to the end of the structural unit neighboring piston drive 54 at a certain distance from each other two stops 38 and 39 each having a hard rubber buffer 36 and 37, respectively, which if the structural unit is elevated and swivelled round 90° can press on one of the two langerons of chassis 1. By this it is assurued that no movements of the structural unit can occur during pure travelling operation.

I claim:

1. A machine for cutting away road surfaces, comprising a preferably self-propelled chassis having an elongated portion extending in the direction of travel and situated above a road surface is to be worked, frame means situated beneath said elongated portion of said chassis between said elongated portion and the road surface, only two suspension means situated one behind the other in the direction of travel and extending between the elongated portion of the chassis and said frame means for suspending the latter from said elongated portion of said chassis, said two suspension means being operatively connected with said frame means to support the latter for free lateral tilting movement about a longitduinal axis extending generally in the direction of travel and situated substantially in a vertical central plane of said chassis, said two suspension means being connected with said elongated portion of said chassis to be carried thereby and one of said suspension means having a universal-joint connection with said frame means to support the latter not only for tilting movement about said longitudinal axis but also for tilting movement about a tranverse axis extending transversely with respect to the direction of travel, and adjusting means operatively connected with the other of the suspension means for raising and lowering the latter so that said frame means can turn about said transverse axis while being raised and lowered and is free to tilt about said longitudinal axis, at least one cutter roller rotatably carried by said frame means and extending downwardly therefrom to engage the road surface so as to work the latter, transmission means carried by said frame means and operatively connected to said cutter roller for transmitting a drive thereto, said transmission means including a gear carried by said frame means, drive means carried by said chassis, and a Cardanic-type shaft connected between said drive means and said gear for transmitting a drive from said drive means to said gear and from the latter through said transmission means to said cutter roller, and a pair of supporting wheels situated on opposite sides of said longitudinal axis and a pair of additional adjusting means carried by said frame means and respectively connected with said supporting wheels to adjust the elevation thereof with respect to said frame means, whereby inclination of said cutting roller with respect to a road surface can be adjusted by said additional pair of adjusting means which adjust the angular position of said frame means and cutting roller with respect to said longitudinal axis while said first-mentioned adjusting means can be actuated to raise the entire frame means and the cutting roller and wheels therewith above the ground surface to a non-working position while said first-mentioned adjusting means can lower the frame means together with the cutting roller to a working position with the depth of cut provided by said cutting roller being determined by said first-mentioned adjusting means.

2. The combination of claim 1 and wherein said one suspension means which has said universal-joint connection with said frame means is situated behind said other suspension means in the direction of travel.

3. The combination of claim 2 and wherein said wheels are situated forwardly of said cutting roller in the direction of travel.

4. The combination of claim 1 and wherein a stop means is carried by said frame means and extends upwardly therefrom toward said elongated portion of said chassis for engaging said elongated portion of said chassis when said frame means is raised to maintain the frame means stationary with respect to the elongated portion of the chassis during travel.

5. The combination of claim 4 and wherein a shock-absorbing means forms part of said stop means.

6. The combination of claim 1 and wherein said elongated portion of said chassis includes an elongated carrier carrying said two suspension means and extending in the direction of travel when said cutting roller extends transversely of the direction of travel, said elongated portion of said chassis also including a traverse extending diagonally with respect to the direction of travel and situated beneath said carrier, and axial bearing means supporting said carrier on said traverse for swivelling movement about a substantially vertical axis.

* * * * *